US006348938B1

(12) United States Patent
Muroi et al.

(10) Patent No.: US 6,348,938 B1
(45) Date of Patent: Feb. 19, 2002

(54) ELECTRO-COAGULATION PRINTER

(75) Inventors: Kunimasa Muroi; Koji Toda, both of Hamamatsu (JP)

(73) Assignee: Yamaha Corporation, Tokyo (JP)

( * ) Notice: Subject to any disclaimer, the term of this patent is extended or adjusted under 35 U.S.C. 154(b) by 0 days.

(21) Appl. No.: 09/685,378

(22) Filed: Oct. 10, 2000

(30) Foreign Application Priority Data

Oct. 12, 1999 (JP) ..... 11-290208

(51) Int. Cl.[7] ..... B41M 5/20

(52) U.S. Cl. ..... 347/163; 101/DIG. 29; 204/483; 346/150.3

(58) Field of Search ..... 347/163, 166; 346/150.3; 101/DIG. 29; 178/62; 204/483, 623

(56) References Cited

U.S. PATENT DOCUMENTS 4,895,629 A * 1/1990 Castegnier et al. ..... 204/483

FOREIGN PATENT DOCUMENTS

| | | |
|---|---|---|
| JP | 4-504688 | 8/1992 |
| JP | 2001-18438 | * 1/2001 |
| WO | 9011897 | 10/1990 |

* cited by examiner

*Primary Examiner*—Joan Pendegrass
(74) *Attorney, Agent, or Firm*—Ostrolenk, Faber, Gerb & Soffen, LLP

(57) ABSTRACT

An electro-coagulation printer is basically constructed by a rotation drum having a circumferential surface which is electrified in positive potential, a number of electrodes which are selectively electrified in negative potentials, and an ink supply device. The electrodes are aligned to oppositely face with the circumferential surface of the rotation drum with a gap which ranges between thirty and one-hundred microns. The ink supply device is arranged in an incoming side of the rotation drum and supplies liquid ink to be injected onto the circumferential surface of the rotation drum, so that electrification is performed between the electrodes and circumferential surface of the rotation drum with intervention of the liquid ink. Thus, a desired image is formed on the circumferential surface of the rotation drum and is transferred onto a printing material such as a paper. In order to prevent the liquid ink from being stuck to surfaces and peripheral portions of the electrodes, electrolyte containing substantially no coagulating components is supplied to the electrodes. Namely, an ink film thickness regulation roller is provided to regulate the liquid ink to a prescribed thickness (T1) which is smaller than the gap, while a gap of a remaining thickness (T2) is filled with the electrolyte. Thus, electrification is performed in such a manner that the liquid ink having the prescribed thickness is placed on the circumferential surface of the rotation drum, while the electrolyte is placed in contact with the electrodes, wherein the liquid ink and electrolyte are arranged in different phases.

6 Claims, 2 Drawing Sheets

ELECTRO-COAGULATION PRINTER

BACKGROUND OF THE INVENTION

1. Field of the Invention

This invention relates to electro-coagulation printers that partially coagulate liquid ink by electrification to form desired images and/or characters being transferred onto printing materials such as papers.

This application is based on Patent Application No. Hei 11-290208 filed in Japan, the content of which is incorporated herein by reference.

2. Description of the Related Art

Conventionally, there are provided electro-coagulation printers, an example of which is disclosed by Japanese Patent Publication No. Hei 4-504688 (which corresponds to International Publication No. WO90/11897), as follows:

The electro-coagulation printer is normally constructed by a rotation drum, plenty of electrodes and an ink supply. The electrodes are arranged to oppositely face with a circumferential surface of the rotation drum by a predetermined gap. In addition, the electrodes are aligned along an axial direction of the rotation drum with prescribed pitches therebetween. The ink supply is arranged in an incoming side of the rotation drum which is prior to proximity arrangement of the electrodes and the circumferential surface of the rotation drum being rotated in a prescribed rotation direction. The ink supply is provided to supply a film of liquid ink on the circumferential surface of the rotation drum. In printing, the plenty of electrodes are being selectively electrified. That is, electrification is performed between selected electrodes and the circumferential surface of the rotation drum with intervention of the ink. Thus, the ink is partially coagulated in response to the selected electrodes to form a desired image, which is transferred onto a printing material such as a paper.

In the electro-coagulation printer disclosed by the aforementioned publication, the liquid ink being filled in gaps between the electrodes and the circumferential surface of the rotation drum is partially subjected to coagulation by electrification wherein the electrodes are electrified in negative potentials while the circumferential surface of the rotation drum is electrified in positive potential, so that partially coagulated ink is being stuck to the circumferential surface of the rotation drum. Herein, there is a possibility in that the coagulated ink is also stuck to peripheral portions of the electrodes, which are arranged opposite to the circumferential surface of the rotation drum. In that case, the coagulated ink may be firmly attached to the peripheral portions of the electrodes, or it covers surfaces of the electrodes. This causes electrification failure (or print failure). The aforementioned publication teaches that the electrification failure can be cleared by cleaning the surfaces and peripheral portions of the electrodes with a rotation brush. However, printing should be interrupted for cleaning, which brings reduction in printing efficiency of the electro-coagulation printer.

SUMMARY OF THE INVENTION

It is an object of the invention to provide an electro-coagulation printer that prevents coagulated ink from being stuck to surfaces and peripheral portions of electrodes under electrification on a rotation drum.

It is another object of the invention to provide an electro-coagulation printer that allows easy and accurate injection of electrolyte flowing between the electrodes and liquid ink.

This invention is applicable to an electro-coagulation printer which is basically constructed by a rotation drum having a circumferential surface being electrified in positive potential, a number of electrodes being selectively electrified in negative potentials, and an ink supply device. The electrodes are aligned to oppositely face with the circumferential surface of the rotation drum with a gap which ranges between thirty and one-hundred microns, for example. The ink supply device is arranged in an incoming side of the rotation drum and supplies liquid ink to be injected onto the circumferential surface of the rotation drum, so that electrification is performed between the electrodes and circumferential surface of the rotation drum with intervention of the liquid ink. Thus, a desired image is formed on the circumferential surface of the rotation drum and is transferred onto a printing material such as a paper.

This invention contributes to improvement of the aforementioned electro-coagulation printer by introducing electrolyte for protection and cleanness of the electrodes. That is, electrolyte containing substantially no coagulating components is supplied to the electrodes to prevent the liquid ink from being stuck to surfaces and peripheral portions of the electrodes. In addition, this invention introduces an ink film thickness regulation roller which is arranged along the incoming side of the rotation drum and is located between the ink supply device and proximity arrangement of the electrodes and circumferential surface of the rotation drum. The ink film thickness regulation roller regulates the liquid ink on the circumferential surface of the rotation drum to a prescribed thickness (T1) which is smaller than the gap between the electrodes and the circumferential surface of the rotation drum. This brings a gap of a remaining thickness (T2) between the electrodes and the ink film having the prescribed thickness. Thus, the electrolyte is being introduced and drawn into the gap of the remaining thickness in contact with the electrodes. Thus, electrification is performed in such a manner that the liquid ink having the prescribed thickness is placed on the circumferential surface of the rotation drum, while the electrolyte is placed in contact with the electrodes, wherein the liquid ink and electrolyte are arranged in different phases.

In the above, the electrolyte is being output from an outlet, which is arranged between the ink film thickness regulation roller and proximity arrangement of the electrodes and circumferential surface of the rotation drum. Incidentally, it is possible to provide circulation of the electrolyte being output from the outlet.

BRIEF DESCRIPTION OF THE DRAWINGS

These and other objects, aspects and embodiment of the present invention will be described in more detail with reference to the following drawing figures, of which.

DESCRIPTION OF THE PREFERRED EMBODIMENT

This invention will be described in further detail by way of examples with reference to accompanying drawings.

Figure 1:
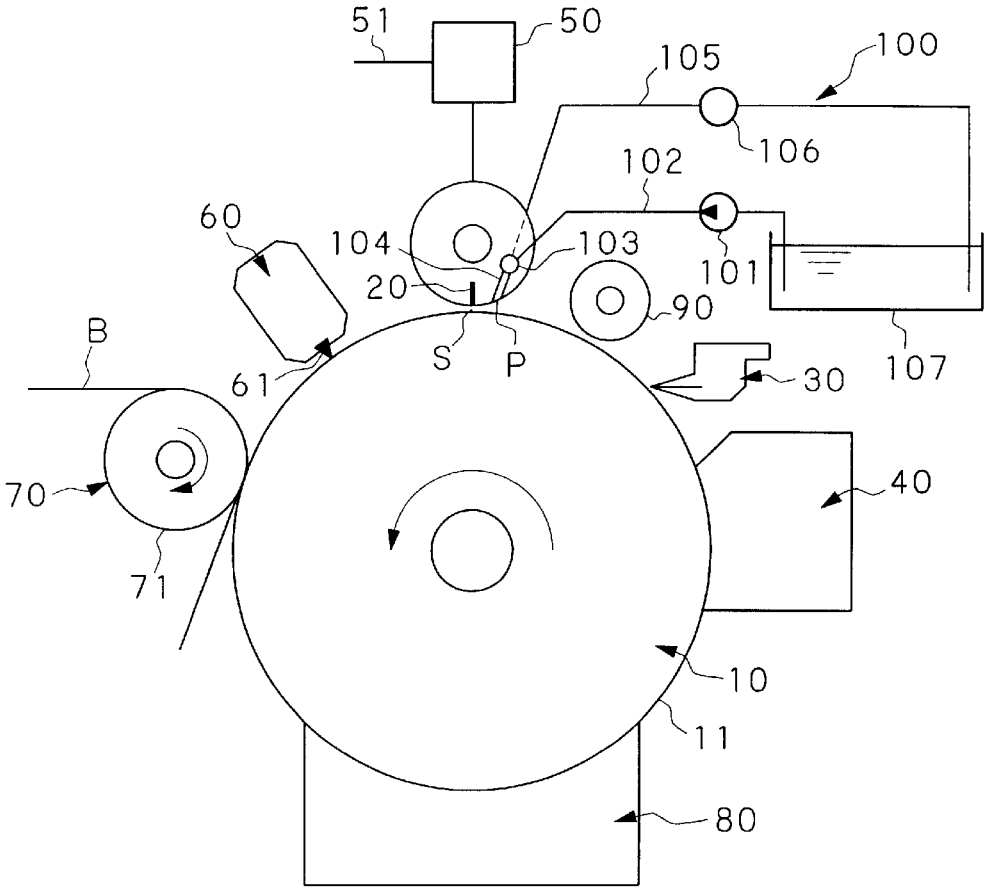
FIG. 1 is a simplified side view partly in section diagrammatically showing an outline construction of an electro-coagulation printer in accordance with a preferred embodiment of the invention.

FIG. 1 diagrammatically shows essential parts of an electro-coagulation printer in accordance with a preferred embodiment of the invention. Basically, the electro-coagulation printer is constructed as similar to one disclosed by the aforementioned publication (i.e., Japanese Patent Publication No. Hei 4-504688). That is, the electro-coagulation printer of FIG. 1 is constructed by a rotation drum 10, negative electrodes 20 (i.e., electrodes being electrified with negative potentials), an ink supply device 30, a coating device 40, an electrification device 50, a removal device 60, a transfer device 70 and a cleaning device 80. In addition, the electro-coagulation printer newly installs an ink film thickness regulation roller 90 and an electrolyte supply device 100.

Figure 2:
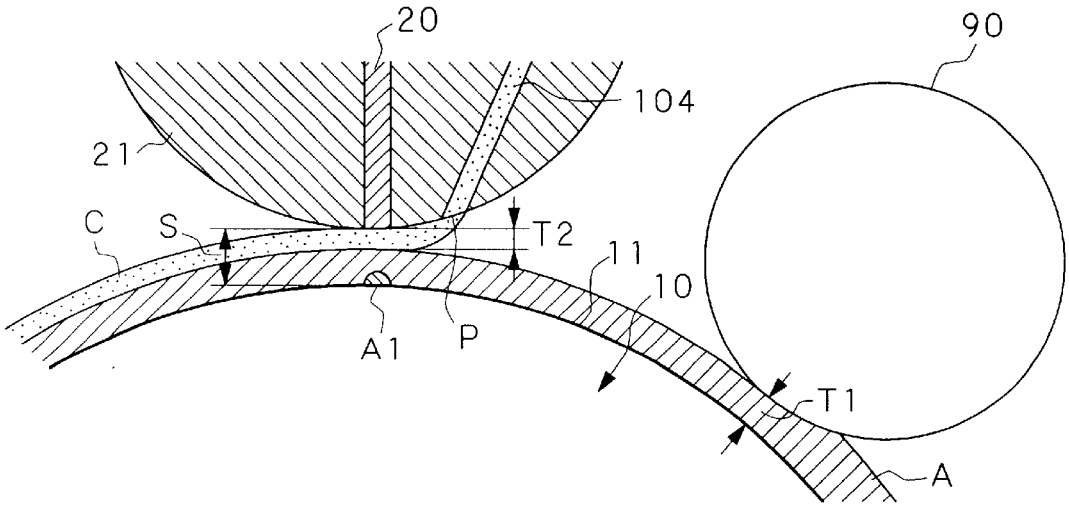
FIG. 2 is an enlarged side view partly in section showing relationships among essential parts of the electro-coagulation printer of FIG. 1.
Figure 3:
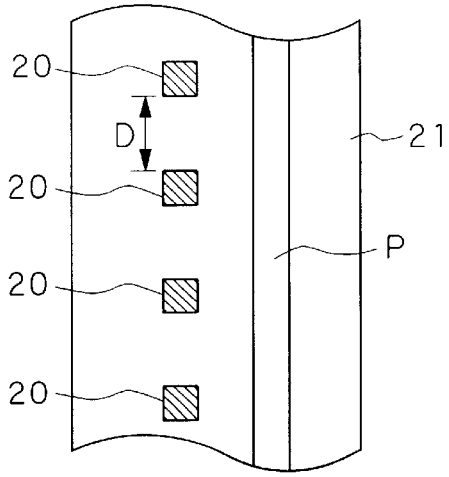
FIG. 3 is a bottom view showing negative electrodes being arranged along an outlet in an insulating resin.

The rotation drum 10 has a circumferential surface which functions as a positive electrode 11. In addition, the rotation drum 10 is supported to rotate freely by a frame (not shown). Further, it is driven to rotate in a counterclockwise direction in FIG. 1 by a drive device (not shown). FIG. 2 shows an magnified image of the negative electrode 20 in side view, while FIG. 3 shows magnified images of the negative electrodes 20 in bottom view. That is, each of the negative electrodes 20 is constructed as a rectangular metal electrode which is buried in an insulating resin 21 and which has a rectangular sectional shape whose one side is measured thirty microns or so. A number of the negative electrodes 20 are linearly aligned along an axial direction of the rotation drum 10, wherein they are aligned with prescribed intervals of distance therebetween which correspond to sixty microns or so. The negative electrodes 20 are assembled with the frame, so that they are placed above the circumferential surface of the rotation drum 10 with gaps. Herein, each of the negative electrodes 20 is placed to oppositely face with the circumferential surface of the rotation drum 10 with a gap S which approximately ranges between thirty microns and one-hundred microns.

The ink supply device 30 is assembled with the frame (not shown) and is arranged in an incoming side of the rotation drum 10 which is prior to proximity arrangement of the negative electrodes and the circumferential surface of the rotation drum 10 being rotated in a prescribed rotation direction (i.e., counterclockwise direction shown by an arrow in FIG. 1). The ink supply device 30 contributes to injection of liquid ink A in a film form onto the circumferential surface of the rotation drum 10. The coating device 40 is also assembled with the frame, wherein it is arranged outside of the ink supply device 30 in the rotation direction and is arranged in connection with the proximity arrangement of the negative electrodes 20 and the circumferential surface of the rotation drum 10. The coating device 40 coats the circumferential surface of the rotation drum 10 continuously with olefin materials containing metallic oxide.

In printing, the electrification device 50 electrifies negative electrodes selected from among the aligned negative electrodes 20. That is, the electrification device 50 performs electrification between the selected negative electrodes 20 and the positive electrode 11 of the rotation drum 10 with intervention of the liquid ink A and electrolyte C, so that the liquid ink A is being partially coagulated and stuck to the circumferential surface of the rotation drum 10 to form a desired image. FIG. 2 shows that a negative electrode 20 being selectively electrified causes a part A1 of the ink to be coagulated and stuck to the circumferential surface of the rotation drum 10. Incidentally, the electrification device 50 performs electrification based on electrification signals, which are transmitted thereto via a cable 51 from a control device (not shown).

The removal device 60 is arranged in an outgoing side of the rotation drum 10 which is behind the gap S (see FIG. 1) being formed in the proximity arrangement of the negative electrodes 20 and the circumferential surface of the rotation drum 10 being rotated in the prescribed rotation direction. The removal device 60 has a flexible rubber knife 61 that removes remaining non-coagulated ink from the circumferential surface of the rotation drum 10. Herein, the removed ink is subjected to reuse. The transfer device 70 is arranged outside of the removal device 60 in the outgoing side of the rotation drum 10. The transfer device 70 contributes to transfer of a desired image, which corresponds to ink being coagulated and stuck to the circumferential surface of the rotation drum 10, onto a printing material B such as a paper. The transfer device 70 installs a pressure roller 71 that rotates in a clockwise direction in FIG. 1. The cleaning device 80 is arranged further outside of the transfer device 70 in the outgoing side of the rotation drum 10. The cleaning device 80 continuously cleans the circumferential surface of the rotation drum 10.

The ink film thickness regulation roller 90 is arranged between the negative electrodes 20 and the ink supply device 30 in the incoming side of the rotation drum 10. The ink film thickness regulation roller 90 is arranged in connection with the liquid ink A which the ink supply device 30 injects onto the circumferential surface of the rotation drum 10 as shown in FIG. 2. That is, the ink film thickness regulation roller 90 is provided to regulate an original film thickness of the liquid ink A to be set to a prescribed small thickness T1, which is smaller than the gap S between the negative electrodes 20 and the circumferential surface of the rotation drum 10. The ink film thickness regulation roller 90 is assembled with the frame in a free rotation manner. This invention is not necessarily designed to use the roller 90 for regulation of the film thickness of the liquid ink. That is, it is possible to employ any types of tools (e.g., blade) suited for regulation of the film thickness of the liquid ink.

The electrolyte supply device 100 has an outlet (or port) P which is arranged in the incoming side of the rotation drum 10 and is arranged close to the proximity arrangement of the negative electrodes 20 and the circumferential surface of the rotation drum 10. Herein, the outlet P has an opening directing toward (the liquid ink A on) the circumferential surface of the rotation drum 10 prior to the negative electrodes 20. When the ink supply device 30 supplies the liquid ink A to be injected onto the circumferential surface of the rotation drum 10, the ink film thickness regulation roller 90 regulates the liquid ink A to the prescribed thickness T1, which provides a remaining gap having a thickness T2 (where T2=S−T1) within the gap S between the negative electrodes 20 and the circumferential surface of the rotation drum 10. So, the electrolyte supply device 100 supplies electrolyte C, which contains substantially no coagulating components, via the outlet P, so that the gap of the thickness T2 is being filled with the electrolyte C. As shown in FIG. 3, the outlet P is formed in a slit-like shape, dimensions of which can be arbitrarily set in consideration of manufacture. The outlet P is formed in the insulating resin 21 in proximity to alignment of the negative electrodes 20 in the incoming side. Incidentally, it is possible to employ other shapes for formation of the outlet P other than the slit-like shape. For example, an outlet is provided in proximity to each negative electrode 20 and is formed in a circular shape or a rectangular shape.

The electrolyte supply device 100 is constructed by a number of parts, namely, a supply pump 101, a supply tube 102, a communicating path 103, a connection path 104, a circulating tube 105 and a control valve 106. Specifically, one end of the supply tube 102 which installs the supply pump 101 is connected to a first end of the communicating path 103 which is provided in the insulating resin 21 together with the connection path 104. In the insulating resin 21, a first end of the connection path 104 is connected with the communicating path 103, and a second end of the connection path 104 is connected with the outlet P. The circulating tube 105 is connected to a second end of the communicating path 103 to circulate remaining electrolyte C back to a tank 107. The circulating tube 105 installs the control valve 106 that controls a flow value of the electrolyte C being supplied to the outlet P via the connection path 104. Circulation of the electrolyte C into the tank 107 provides natural cooling of the electrolyte C.

The electro-coagulation printer of the present embodiment performs electro-coagulation printing, which is realized by a number of steps as follows:

(1) Coating step in which the circumferential surface of the rotation drum 10 is coated with the olefin material containing metallic oxide by the coating device 40.

(2) Ink supply step in which the ink supply device 30 supplies the liquid ink A to be injected onto the circumferential surface of the rotation drum 10.

(3) Ink film thickness regulation step in which the ink film thickness regulation roller 90 regulates the liquid ink A, which is injected onto the circumferential surface of the rotation drum 10, to the prescribed thickness T1, so that a gap of the thickness T2 is formed within the gap S between the negative electrodes 20 and the circumferential surface of the rotation drum 10.

(4) Electrolyte supply step in which the electrolyte supply device 100 supplies the electrolyte C to the gap of the thickness T2 between the liquid ink A and the negative electrodes 20.

(5) Coagulation step in which the liquid ink A is partially coagulated to form a desired image in connection with the negative electrodes 20 which are selectively electrified and placed opposite to the circumferential surface of the rotation drum 10.

(6) Removal step in which the removal device 60 removes remaining noncoagulated ink from the circumferential surface of the rotation drum 10.

(7) Transfer step in which the desired image is transferred onto a printing material B from the circumferential surface of the rotation drum 10.

(8) Cleaning step in which the cleaning device 80 cleans the circumferential surface of the rotation drum 10.

Due to the aforementioned steps, it is possible to perform satisfactory printing on the printing material B.

It is repeated that in the electro-coagulation printer of the present embodiment, the ink film thickness regulation roller 90 arranged between alignment of the negative electrodes and the ink supply device 30 in the incoming side of the rotation drum 10 regulates the liquid ink A to the prescribed thickness T1 which is smaller than the gap S between the negative electrodes 20 and the circumferential surface of the rotation drum 20. Prior to the proximity arrangement of the negative electrodes 20 and the circumferential surface of the rotation drum 10 in the incoming side, the gap of the thickness T2 is formed between the negative electrodes 20 and the liquid ink A having the regulated thickness T1 and is filled with the electrolyte C, which is supplied from the electrolyte supply device 100 and which contains substantially no coagulating components.

In the gap S between the negative electrodes 20 and the circumferential surface of the rotation drum 10, electrification is performed with intervention of double films, i.e., a first film corresponding to the liquid ink A on the circumferential surface of the rotation drum 10 and a second film corresponding to the electrolyte C below the negative electrodes 20. Due to provision of the second film corresponding to the electrolyte C, it is possible to certainly prevent coagulated ink from being stuck to surfaces and peripheral portions of the negative electrodes 20. This reduces a frequency of work for removing the coagulated ink from the surfaces and peripheral portions of the negative electrodes 20 by some removal tools such as a rotation brush, or it is possible to eliminate necessity for performing such a work. Thus, it is possible to improve a printing efficiency by reducing a number of times in interruption of printing or by eliminating necessity of interruption of printing.

It is also repeated that in the present embodiment, the ink film thickness regulation roller 90 regulates the liquid ink A to the prescribed thickness T1 which is smaller than the gap S between the negative electrodes 20 and the circumferential surface of the rotation drum 10, so that the gap of the thickness T2 is being formed between the liquid ink A and the negative electrodes 20. Due to reduction of thickness of the liquid ink A, substantially no pressure is caused by the liquid ink A in the gap between the negative electrodes 20 and the rotation drum 10.

Therefore, the electrolyte supply device 100 that supplies the electrolyte C between the liquid ink A and the negative electrodes 20 can be constructed with a simple structure that is required to merely supply the electrolyte C to the gap of the thickness T2 between the liquid ink A and the negative electrodes 20. The outlet P is not necessarily made by fine work to appropriately control discharge pressure of the electrolyte C which is output from the outlet P to maintain a good balance with the pressure of the liquid ink. Hence, it is possible to simplify the structure of the electrolyte supply device 100. As a result, it is possible to reduce entire cost for manufacturing the electro-coagulation printer using the electrolyte supply device.

Figure 4:
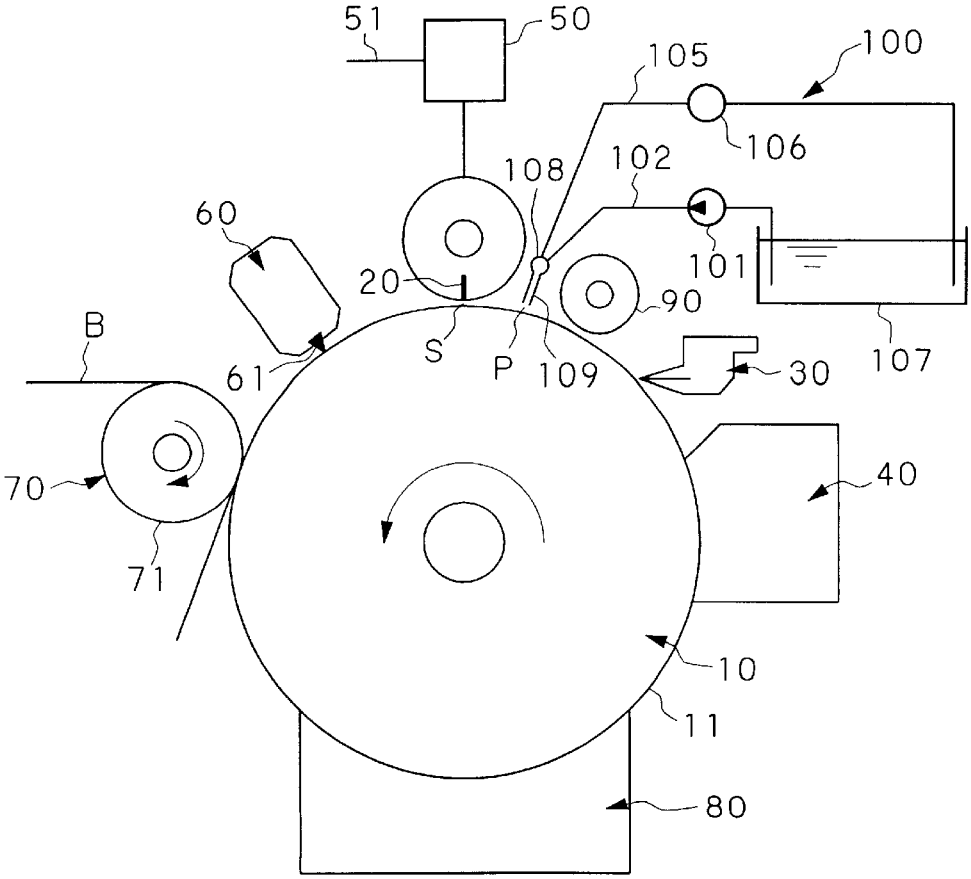
FIG. 4 is a simplified side view showing a modified example of the electro-coagulation printer shown in FIG. 1.

In the foregoing embodiment shown in FIG. 1, the outlet P of the electrolyte supply device 100 is provided in the insulating resin 21, which constructs the electrode unit together with the negative electrodes 20. It is possible to modify the embodiment of FIG. 1 such that as shown in FIG. 4, an outlet P of the electrolyte supply device 100 is provided independently of the electrode unit. This requires further modifications in which the communicating path 103 is modified to a communicating tube 108, and the connection path 104 is modified to a connection tube 109. Such a modified example of the electro-coagulation printer shown in FIG. 4 has an advantage in that the electrolyte supply device 100 can be constructed to be independently of the electrode unit. That is, the electrode unit can be further simplified in construction, so it is possible to further reduce cost for manufacturing the electro-coagulation printer.

In the foregoing embodiment shown in FIGS. 1 and 2, when the ink supply device 30 supplies the liquid ink A which is injected onto the circumferential surface of the rotation drum 10, the ink film thickness regulation roller 90 regulates the liquid ink A to the prescribed thickness T1 so that the gap of the remaining thickness T2 is being formed between the negative electrodes 20 and the regulated liquid ink A having the thickness T1, wherein the gap of the thickness T2 is filled with the electrolyte C which is supplied from the electrolyte supply device 100 and which contains substantially no coagulating components. In this case, the electrolyte supply device 100 does not necessarily perform continuous and uniform operations for supplying the electrolyte C to the gap of the thickness T2. It is possible to partially modify the embodiment in consideration of the rotation of the rotation drum 10, as follows:

Due to rotation of the rotation drum 10, the liquid ink A is subjected to movement along the circumferential surface of the rotation drum 10 in its rotation direction. Such movement of the liquid ink A accompanied with the rotation of the rotation drum 10 causes partial movement of the electrolyte C being supplied from the electrolyte supply device 100 toward the gap of the thickness T2. That is, a part of the electrolyte C is moved toward and drawn into the gap of the thickness T2 between the negative electrodes 20 and the liquid ink A, while an excess of the electrolyte C is stagnated in a space between the electrode unit and the ink film thickness regulation roller 90.

The foregoing embodiment is designed such that the ink film thickness regulation roller 90 is constructed independently of the ink supply device 30. Namely, the foregoing embodiment is designed to sequentially perform the ink supply step and the ink film thickness regulation step in turn. In other words, after the ink supply step in which the ink supply device 30 supplies the liquid ink A to be injected onto the circumferential surface of the rotation drum 10, the embodiment implements the ink film thickness regulation step in which the ink film thickness regulation roller 90 regulates the liquid ink A to the prescribed thickness T1. It is possible to modify the embodiment such as to combine functions of the ink film thickness regulation roller 90 and ink supply device 30 together. In short, it is possible to provide a regulated ink supply device which substitutes for the ink film thickness regulation roller 90 and ink supply device 30. Concretely speaking, the regulated ink supply device is constructed by a die-coater which is capable of coating the circumferential surface of the rotation drum with the liquid ink in the prescribed thickness by way of a slit. Using the regulated ink supply device, it is possible to simultaneously perform the ink supply step and ink film thickness regulation step.

As described heretofore, this invention has various effects and technical features, which are summarized as follows:

(1) In the electro-coagulation printer of this invention, the ink supply device supplies the liquid ink which is regulated to the prescribed thickness which is smaller than the gap between the electrodes and the circumferential surface of the rotation drum. In addition, the electrolyte supply device supplies the electrolyte such that the gap being formed between the electrodes and the regulated liquid ink having the prescribed thickness is filled with the electrolyte which contains substantially no coagulating components. Therefore, electrification is effected between the electrodes and the circumferential surface of the rotation drum with intervention of double films, wherein a first film corresponds to the regulated liquid ink placed on the circumferential surface of the rotation drum and a second film corresponds to the electrolyte being placed in contact with the electrodes. Due to intervention using the second film corresponding to the electrolyte, it is possible to certainly prevent the coagulated ink from being stuck to the surfaces and peripheral portions of the electrodes. This reduces a frequency of cleaning work for removing the coagulated ink from the surfaces and peripheral portions of the electrodes by the cleaning device using the rotation brush, or this eliminates necessity for performing the cleaning work. Thus, it is possible to improve a printing efficiency by reducing a number of times of interruption in printing or by eliminating interruption of the printing due to cleaning.

(2) In the electro-coagulation printer of this invention, the ink supply device and ink film thickness regulation roller works together to provide the regulated liquid ink having the prescribed thickness which is smaller than the gap between the electrodes and the circumferential surface of the rotation drum, so that a certain gap is being formed between the electrodes and regulated liquid ink. Due to provision of such a gap, the liquid ink may cause substantially no pressure to be effected in the gap between the electrodes and the circumferential surface of the rotation drum. Therefore, the electrolyte supply device can be constructed with a simple structure that merely supplies the electrolyte to the gap between the electrodes and regulated liquid ink. In addition, an outlet of the electrolyte supply device is not necessarily made by fine work because the electrolyte supply device does not need to appropriately control discharge pressure of the electrolyte to maintain a good balance with pressure of the liquid ink. Because of the simple structure of the electrolyte supply device, it is possible to reduce entire cost for manufacturing the electro-coagulation printer. Further, the electrolyte supply device is merely arranged in the incoming side in proximity to the gap between the electrodes and the circumferential surface of the rotation drum. Besides, the electrolyte supply device can be constructed independently of the electrode unit, which can be simplified in construction. Because of simplification of the construction of the electrode unit, it is possible to further reduce the entire cost for manufacturing the electro-coagulation printer.

As this invention may be embodied in several forms without departing from the spirit of essential characteristics thereof, the present embodiment and its modifications are therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An electro-coagulation printer comprising:

a rotation drum having a circumferential surface on which a film of liquid ink is formed;

a plurality of electrodes which are aligned to oppositely face with the circumferential surface of the rotation drum by a prescribed gap and which are being selectively electrified;

an ink supply device which is arranged in an incoming side in connection with proximity arrangement of the electrodes and the circumferential surface of the rotation drum, wherein the ink supply device supplies the liquid ink onto the circumferential surface of the rotation drum in the incoming side such as to provide the film of the liquid ink having a regulated thickness which is smaller than the gap between the electrodes and the circumferential surface of the rotation drum; and an electrolyte supply device for supplying electrolyte which contains substantially no coagulating components and which fills a remaining gap formed between the electrodes and the film of the liquid ink having the regulated thickness within the gap, wherein electrification is performed between selected electrodes and the circumferential surface of the rotation drum with intervention of the electrolyte and the liquid ink to form a desired image on the circumferential surface of the rotation drum, which is transferred onto a printing material.

2. An electro-coagulation printer comprising:

a rotation drum having a circumferential surface which is electrified in positive potential, wherein the rotation drum is being rotated in a prescribed direction;

a plurality of electrodes which are aligned to oppositely face with the circumferential surface of the rotation drum with a gap and which are selectively electrified in negative potentials;

an ink supply device for supplying liquid ink to be injected onto the circumferential surface of the rotation drum in an incoming side;

an ink film thickness regulator which is arranged along the incoming side of the rotation drum and is located between the ink supply device and proximity arrangement of the electrodes and the circumferential surface of the rotation drum, the ink film thickness regulator regulating the liquid ink to a first thickness which is smaller than the gap between the electrodes and the circumferential surface of the rotation drum;

an electrolyte supply device having an outlet which is arranged in the incoming side of the rotation drum and is located between the ink film thickness regulator and the proximity arrangement of the electrodes and the circumferential surface of the rotation drum, the electrolyte supply device supplying electrolyte containing substantially no coagulating components by way of the outlet so that the electrolyte is drawn into a gap of a second thickness, which is provided between the electrodes and the liquid ink having the first thickness, in response to rotation of the rotation drum, wherein electrification is performed between selected electrodes and the circumferential surface of the rotation drum with intervention of the electrolyte and the liquid ink such as to form a desired image on the circumferential surface of the rotation drum, which is transferred onto a printing material.

3. An electro-coagulation printer according to claim 2 wherein the ink film thickness regulator is constructed as a roller that rotates in connection with the rotation drum with intervention of the liquid ink therebetween.

4. An electro-coagulation printer according to claim 2 wherein the outlet is formed in a slit shape which is arranged along and in proximity to alignment of the electrodes.

5. An electro-coagulation printer according to claim 2 wherein the electrolyte supply device incorporates a circulator that partially circulates the electrolyte being output from the outlet.

6. An electro-coagulation printer according to claim 2 wherein the first thickness of the liquid ink being regulated by the ink film thickness regulator is sufficiently smaller than the gap that ranges from thirty to one-hundred microns.

* * * * *